US011443687B2

(12) United States Patent
Son et al.

(10) Patent No.: US 11,443,687 B2
(45) Date of Patent: Sep. 13, 2022

(54) DISPLAY DEVICE

(71) Applicant: SAMSUNG DISPLAY CO., LTD., Yongin-si (KR)

(72) Inventors: Min Seong Son, Yongin-si (KR); Seung Kyu Lee, Yongin-si (KR); Sun Joon Hwang, Yongin-si (KR); Yun Seong Kim, Yongin-si (KR); Youn Woo Choe, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/242,818

(22) Filed: Apr. 28, 2021

(65) Prior Publication Data

US 2021/0375193 A1 Dec. 2, 2021

(30) Foreign Application Priority Data

May 28, 2020 (KR) ..... 10-2020-0064183

(51) Int. Cl.
*G09G 3/32* (2016.01)

(52) U.S. Cl.
CPC ..... *G09G 3/32* (2013.01); *G09G 2300/0426* (2013.01); *G09G 2310/027* (2013.01); *G09G 2310/0267* (2013.01); *G09G 2310/08* (2013.01)

(58) Field of Classification Search
CPC ..... G09G 3/32; G09G 2310/0267; G09G 2300/0426; G09G 2310/08; G09G 2310/027
See application file for complete search history.

(56) References Cited

U.S. PATENT DOCUMENTS

| | | | |
|---|---|---|---|
| 7,414,599 | B2 | 8/2008 | Chung et al. |
| 8,456,397 | B2 | 6/2013 | Kim et al. |
| 9,024,934 | B2 | 5/2015 | Park et al. |
| 9,373,662 | B2 | 6/2016 | Her et al. |
| 9,824,632 | B2 | 11/2017 | Chaji et al. |
| 10,255,855 | B2 | 4/2019 | Park et al. |
| 10,475,386 | B2 | 11/2019 | Kim |
| 11,056,060 | B2 | 7/2021 | Kim et al. |
| 2006/0221005 | A1 | 10/2006 | Omata et al. |

(Continued)

FOREIGN PATENT DOCUMENTS

| | | | |
|---|---|---|---|
| KR | 100560780 | B1 | 3/2006 |
| KR | 1020140013586 | A | 2/2014 |

(Continued)

*Primary Examiner* — Muhammad N Edun
(74) *Attorney, Agent, or Firm* — Cantor Colburn LLP

(57) ABSTRACT

A display device includes a pixel including a first transistor coupled between a first node and a second node, an emission driver supplying an emission control signal at a first frequency to an emission control line, a scan driver supplying first to fourth scan signals respectively to first to fourth scan lines, a data driver supplying a data signal to a data line, and a timing controller. The first scan signal controls a timing at which a voltage of a first power source is supplied to the first node or the second node, and the second scan signal controls a timing at which a first electrode of the first transistor and a gate electrode of the first transistor are coupled to each other. The scan driver controls a bias state of the first transistor by supplying, plural times, the first and second scan signals in a non-emission period.

18 Claims, 9 Drawing Sheets

(56) References Cited

U.S. PATENT DOCUMENTS

| | | | | |
|---|---|---|---|---|
| 2013/0169702 | A1* | 7/2013 | Ono | G09G 5/10 345/690 |
| 2016/0365035 | A1* | 12/2016 | Park | G09G 3/3266 |
| 2017/0193918 | A1* | 7/2017 | Bae | G09G 3/3291 |
| 2018/0190196 | A1 | 7/2018 | Kwon et al. | |
| 2018/0308918 | A1 | 10/2018 | Choi et al. | |
| 2020/0394961 | A1 | 12/2020 | Kim et al. | |
| 2021/0027696 | A1* | 1/2021 | Kim | G09G 3/32 |
| 2021/0049965 | A1* | 2/2021 | Jeon | G09G 3/3233 |
| 2022/0028329 | A1 | 1/2022 | Kim et al. | |

FOREIGN PATENT DOCUMENTS

| | | | |
|---|---|---|---|
| KR | 101490894 | B1 | 2/2015 |
| KR | 1020160052844 | A | 5/2016 |
| KR | 1020170049787 | A | 5/2017 |
| KR | 1020190002940 | A | 1/2019 |
| KR | 1020200142646 | A | 12/2020 |

* cited by examiner

DISPLAY DEVICE

The application claims priority to Korean patent application 10-2020-0064183, filed on May 28, 2020, and all the benefits accruing therefrom under 35 U.S.C. § 119, the content of which in its entirety is herein incorporated by reference.

BACKGROUND

1. Field

Embodiments of the invention generally relate to a display device, and more particularly, to a display device applied to various frame frequencies.

2. Related Art

A display device displays an image by control signals applied from an outside.

The display device includes a plurality of pixels. Each of the pixels includes a plurality of transistors, a light emitting device electrically coupled to the plurality of transistors, and a capacitor. The plurality of transistors generates a driving current, based on signals provided through signal lines, and the light emitting device emits light, based on the driving current.

A display device for low power consumption is desired so as to improve a driving efficiency of the display device. The power consumption of the display device may be reduced by lowering a driving frequency (or data write frequency) when a still image is displayed, for example. In addition, the display device may display an image at various frame frequencies (or driving frequencies) so as to achieve an image display in various conditions.

SUMMARY

A leakage of a driving current may occur in a pixel due to a low driving frequency, and a flicker of an image, or the like may be recognized. In addition, image distortion may be viewed due to a change in frame frequency, a change in frame response speed, or the like.

Embodiments provide a display device capable of improving image quality with respect to various frame frequencies by controlling a bias state of a driving transistor of a pixel.

Embodiments also provide a driving method of the display device.

In accordance with an embodiment of the invention, there is provided a display device including a pixel including a first transistor coupled between a first node and a second node to generate a driving current, the pixel being connected to a first scan line, a second scan line, a third scan line, a fourth scan line, an emission control line, and a data line, an emission driver which supplies an emission control signal at a first frequency to the emission control line, a scan driver which supplies first to fourth scan signals respectively to the first to fourth scan lines in a period in which the emission control signal is supplied, a data driver which supplies a data signal to the data line, and a timing controller which controls driving of the scan driver, the emission driver, and the data driver, where the first scan signal controls a timing at which a voltage of a first power source is supplied to the first node or the second node, and the second scan signal controls a timing at which a first electrode of the first transistor and a gate electrode of the first transistor are coupled to each other, and where the scan driver controls a bias state of the first transistor by supplying, plural times, the first scan signal and the second scan signal in a non-emission period in which the emission control signal is supplied.

In an embodiment, the pixel may further include a light emitting device, a second transistor coupled between the data line and the first node, the second transistor being turned on in response to the fourth scan signal supplied to the fourth scan line, a third transistor coupled between the second node and a third node connected to the gate electrode of the first transistor, the third transistor being turned on in response to the second scan signal, a fourth transistor turned on in response to the first scan signal supplied to the first scan line to apply the voltage of the first power source to the first transistor, a fifth transistor coupled between a driving power source and the first node, the fifth transistor being turned off in response to the emission control signal supplied to the emission control line, and a sixth transistor coupled between the second node and a first electrode of the light emitting device, the sixth transistor being turned off in response to the emission control signal supplied to the emission control line.

In an embodiment, in a first period of the non-emission period, the scan driver may supply the second scan signal to the second scan line, and supply the first scan signal to the first scan line.

In an embodiment, in the first period, the fourth transistor may be turned on after the third transistor is turned on.

In an embodiment, in the first period, a time length during which the third transistor is turned on may be longer than a time length during which the fourth transistor is turned on.

In an embodiment, the pixel may further include a seventh transistor coupled between the third node and a second power source, the seventh transistor being turned on in response to the third scan signal supplied to the third scan line.

In an embodiment, the scan driver may supply the third scan signal to the third scan line in a second period of the non-emission period, and supply the second scan signal to the second scan line in a third period of the non-emission period.

In an embodiment, the second period may be started between the first period and the third period.

In an embodiment, in the third period, the scan driver may supply the fourth scan signal to the fourth scan line while overlapping with a portion of the second scan signal.

In an embodiment, the scan driver may again supply the first scan signal to the first scan line in a fourth period after the third period.

In an embodiment, the supply of the first to fourth scan signals may be suspended during a remained period of the non-emission period after the fourth period. A time length of the remained period may be greater than a pulse width of the first scan signal.

In an embodiment, the time length of the remained period may be equal to or greater than about 10 microseconds (μs).

In an embodiment, the pixel may further include an eighth transistor coupled between the first electrode of the light emitting device and a third power source, the eighth transistor being turned on in response to the first scan signal.

In an embodiment, one electrode of the fourth transistor may be coupled to the first node.

In an embodiment, one electrode of the fourth transistor may be coupled to the second node.

In an embodiment, the scan driver may include a first scan driver which supplies a plurality of first scan signals to the first scan line during the non-emission period, a second scan driver which supplies a plurality of second scan signals to the second scan line during the non-emission period, a third scan driver which supplies the third scan signal to the third scan line between times at which the second scan signals are supplied, and a fourth scan driver which supplies the fourth scan signal to the fourth scan line while overlapping with portions of the second scan signals.

In an embodiment, the scan driver may supply the third scan signal and the fourth scan signal at a second frequency corresponding to a frame frequency. The second frequency may be lower than the first frequency.

In an embodiment, a frame period may include a plurality of non-emission periods. The scan driver may supply the first scan signal in the non-emission periods. The scan driver may supply the second scan signal, the third scan signal, and the fourth scan signal only in a first non-emission period among the non-emission periods.

In the display device in accordance with the invention, the fourth transistor is turned on in a state in which the third transistor is turned on before a data signal is written in the display scan period of variable frequency driving and low-frequency driving. Thus, luminance uniformity may be improved, and occurrence of a flicker may be minimized.

Further, all the transistors of the pixel are turned off (i.e., the scan signals are not supplied) during a time length equal to or greater than 10 μs between the fourth period in which the voltage of the first power source is supplied to the pixel and a start of the emission period, so that the on-bias state of the first transistor may be reset before light emission. Thus, an unintended increase in luminance, which is caused by initialization of the gate voltage of the first transistor (i.e., in the second period) may be suppressed or prevented.

Accordingly, the image quality of the display device to which variable frame frequency driving including a plurality of emission periods and a plurality of non-emission periods in one frame period may be improved.

BRIEF DESCRIPTION OF THE DRAWINGS

Embodiments will now be described more fully hereinafter with reference to the accompanying drawings, in which.

DETAILED DESCRIPTION

Figure 1:
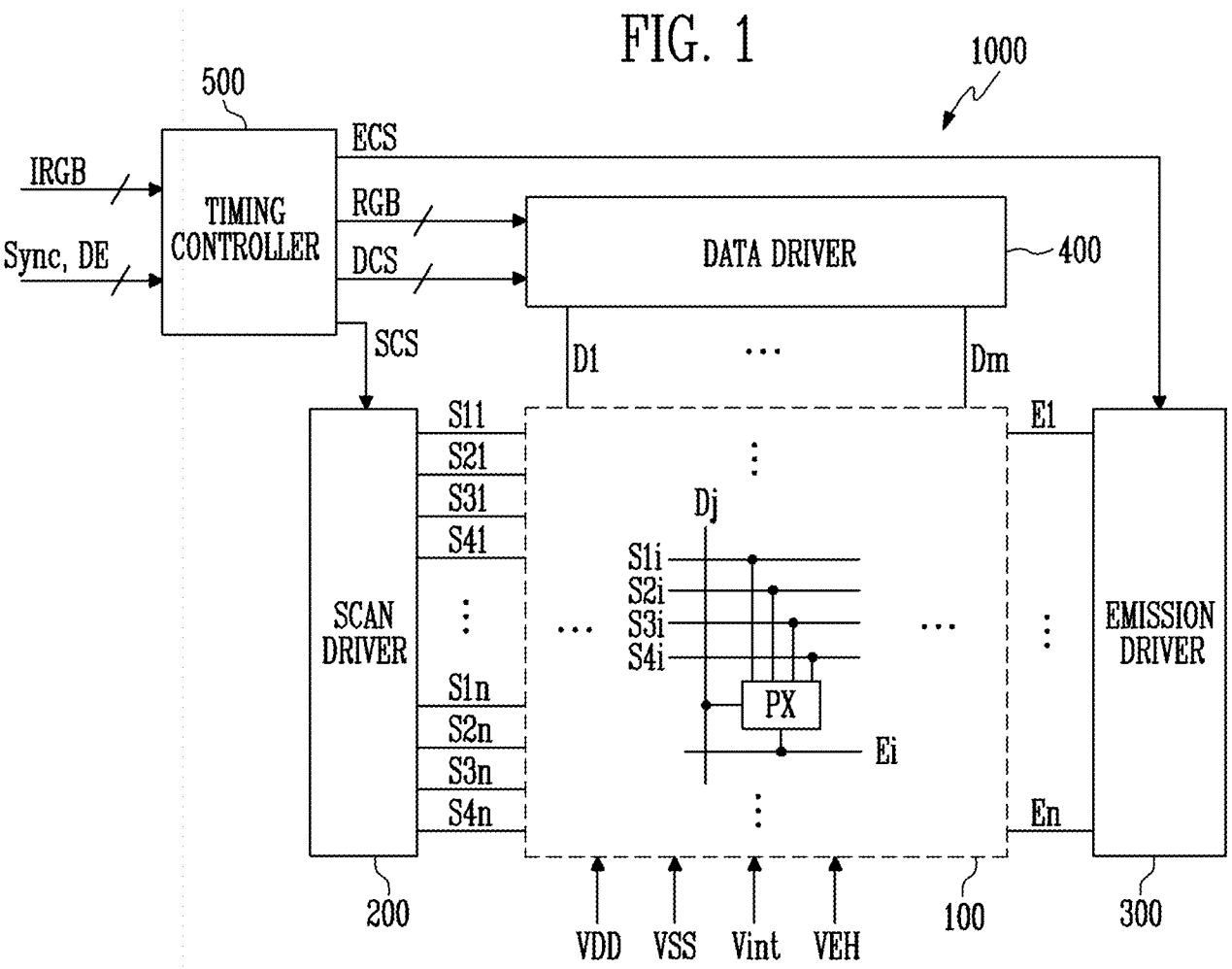
FIG. 1 is a diagram illustrating an embodiment of a display device in accordance with the invention.

Hereinafter, embodiments of the invention will be described in more detail with reference to the accompanying drawings. Throughout the drawings, the same reference numerals are given to the same elements, and their overlapping descriptions will be omitted.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Inventive features may be embodied in different forms and should not be construed as limited to the embodiments set forth herein. Rather, these embodiments are provided so that this invention will be thorough and complete, and will fully convey the scope of the embodiments to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a diagram illustrating an embodiment of a display device in accordance with the invention.

Referring to FIG. 1, the display device 1000 may include a pixel unit 100, a scan driver 200, an emission driver 300, a data driver 400, and a timing controller 500.

The display device 1000 may display an image at various frame frequencies (e.g., refresh rates, driving frequencies, or screen refresh rates) according to a driving condition. The frame frequency is a frequency at which a data voltage is substantially written to a driving transistor of a pixel PX for one second. For example, the frame frequency is referred to as a screen scanning rate or a screen refresh frequency, and represents a frequency at which a display screen is refreshed for one second, for example.

In an embodiment, an output frequency of a fourth scan signal supplied to a fourth scan line S4*i* to supply a data signal from the data driver 400 may be changed corresponding to a frame frequency. In an embodiment, a frame frequency for displaying a moving image may be equal to or higher than about 60 Hertz (Hz), for example. In the embodiment, the frame frequency may be about 120 Hz, for example. The fourth scan signal may be supplied to each horizontal line (pixel row) 60 times for one second (s).

In an embodiment, the display device 1000 may control an output frequency of the scan driver 200 and the emission driver 300 and an output frequency of the data driver 400, which corresponds thereto. In an embodiment, the display device 1000 may display an image, corresponding to various frame frequencies of about 1 Hz to about 120 Hz, for example. However, this is merely illustrative, and the display device 1000 may display an image at a frame frequency equal to or higher than about 120 Hz, for example. In the embodiment, the display device 1000 may display the image at the frame frequency of about 240 Hz or about 480 Hz, for example.

The pixel unit 100 may include scan lines S11 to S1*n*, S21 to S2*n*, S31 to S3*n*, and S41 to S4*n*, emission control lines E1 to En, and data lines D1 to Dm (m and n are integers greater than one). Also, the pixel unit 100 may include pixels PX coupled to the scan lines S11 to S1*n*, S21 to S2*n*, S31 to S3*n*, and S41 to S4*n*, the emission control lines E1 to En, and the data lines D1 to Dm. Each of the pixels PX may include a driving transistor and a plurality of switching transistors.

In an embodiment, the timing controller 500 may be supplied with input image data IRGB and control signals Sync and DE from a host system (not shown) such as an application processor ("AP") through a predetermined interface, for example.

The timing controller 500 may generate a first control signal SCS, a second control signal ECS, and a third control signal DCS, based on input image data IRGB, a synchronization signal (e.g., a vertical synchronization signal, a horizontal synchronization signal, etc.), an internal data enable signal, a clock signal, and the like. The first control signal SCS may be supplied to the scan driver 200, the second control signal ECS may be supplied to the emission driver 300, and the third control signal DCS may be supplied to the data driver 400. The timing controller 500 may realign the input image data IRGB and supply the realigned data to the data driver 400.

The scan driver 200 may receive the first control signal SCS from the timing controller 500, and supply a first scan signal, a second scan signal, a third scan signal, and a fourth scan signal respectively to first scan lines S11 to S1*n*, second scan lines S21 to S2*n*, third scan lines S31 to S3*n*, and fourth scan lines S41 to S4*n*.

The first to fourth scan signals may be set to a gate-on voltage (e.g., a low voltage) corresponding to the type of a transistor to which the corresponding scan signals are supplied. The transistor receiving a scan signal may be set to a turn-on state when the scan signal is supplied. In an embodiment, a gate-on voltage of a scan signal supplied to a p-channel metal oxide semiconductor ("PMOS") transistor may have a logic low level, and a gate-on voltage of a scan signal supplied to an n-channel metal oxide semiconductor ("NMOS") transistor may have a logic high level, for example. Hereinafter, an expression "scan signal is supplied" may mean that the scan signal is supplied at a logic level at which a transistor controlled by the scan signal is turned on.

In an embodiment, the scan driver 200 may supply some of the first to fourth scan signals plural times in a non-emission period. Accordingly, a bias state of the driving transistor included in the pixel PX may be controlled.

The emission driver 300 may supply an emission control signal to the emission control lines E1 to En, based on the second control signal ECS. In an embodiment, the emission control signal may be sequentially supplied to the emission control lines E1 to En, for example.

The emission control signal may be set to a gate-off voltage (e.g., a high voltage). A transistor receiving the emission control signal may be turned off when the emission control signal is supplied, and be set to the turn-on state in other cases. Hereinafter, an expression "emission control signal is supplied" may mean that the emission control signal is supplied at a logic level at which a transistor controlled by the emission control signal is turned off.

For convenience of description, a case where each of the scan driver 200 and the emission driver 300 is a single component is illustrated in FIG. 1, but the invention is not limited thereto. According to a design, the scan driver 200 may include a plurality of scan drivers which respectively supply at least one of the first to fourth scan signals. Also, at least portions of the scan driver 200 and the emission driver 300 may be integrated as a single driving circuit, a single module, etc.

The data driver 400 may receive the third control signal DCS and image data RGB from the timing controller 500. The data driver 400 may convert the image data RGB in a digital form into an analog data signal (data voltage). The data driver 400 may supply a data signal to the data lines D1 to Dm, corresponding to the third control signal DCS. The data signal supplied to the data lines D1 to Dm may be supplied in synchronization with the fourth scan signal supplied to the fourth scan lines S41 to S4*n*.

In an embodiment, the display device 1000 may further include a power supply. The power supply may supply, to the pixel unit 100, a voltage of a first driving power source VDD for driving the pixel PX, a voltage of a second driving power source VSS, a voltage of a first power source VEH (or bias power source), and a voltage of a second power source Vint (or initialization power source. The second power source Vint may include initialization power sources (e.g., Vint1 and Vint2 shown in FIG. 3) output at different voltage levels.

The display device 1000 may operate at various frame frequencies. In the case of low-frequency driving, an image failure such as a flicker may be viewed due to current leakage in the pixel. In addition, an afterimage such as image attraction may be viewed according to a change in bias state of the driving transistor when the display device is driven at various frame frequencies, a change in response speed due to a threshold voltage shift caused by a change in hysteresis characteristic, or the like.

In order to improve image quality, one frame period of the pixel PX may include one display scan period and one bias scan period according to a frame frequency. Operations of the display scan period and the bias scan period will be described in detail with reference to FIGS. 4 and 5.

Figure 2:
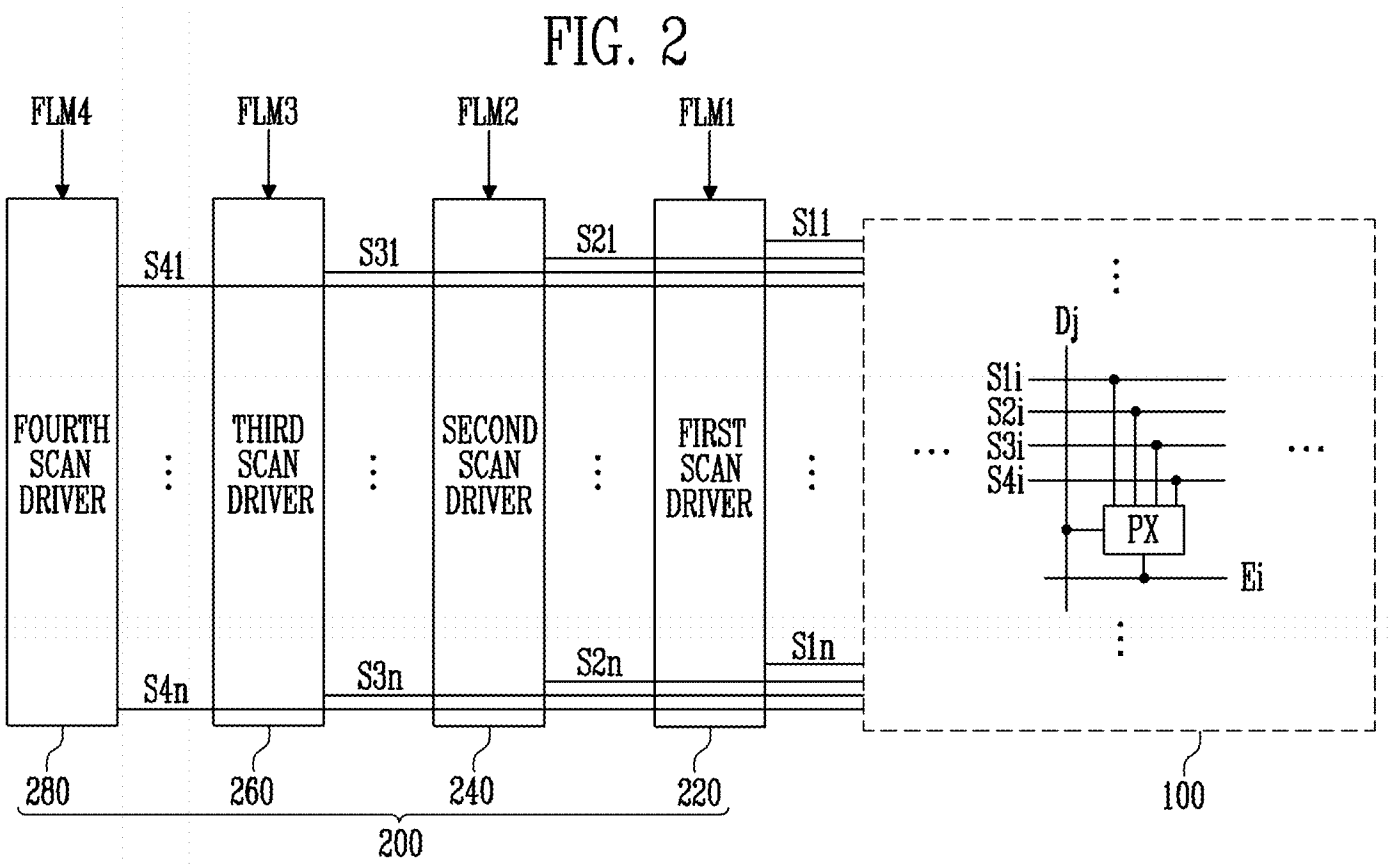
FIG. 2 is a diagram illustrating an embodiment of a scan driver included in the display device shown in FIG. 1.

FIG. 2 is a diagram illustrating an embodiment of the scan driver included in the display device shown in FIG. 1.

Referring to FIGS. 1 and 2, the scan driver 200 may include a first scan driver 220, a second scan driver 240, a third scan driver 260, and a fourth scan driver 280.

The first control signal SCS may include first to fourth scan start signals FLM1 to FLM4. The first to fourth scan start signals FLM1 to FLM4 may be respectively supplied to the first to fourth scan drivers 220, 240, 260, and 280.

Widths, supply timings, etc., of the first to fourth scan start signals FLM1 to FLM4 may be determined according to a driving condition of the pixel PX and a frame frequency. The first to fourth scan signals may be respectively output based on the first to fourth scan start signals FLM1 to FLM4. In an embodiment, a pulse width of at least one scan signal among the first to fourth scan signals may be different from that of the other scan signals, for example.

The first scan driver 220 may sequentially supply the first scan signal to the first scan lines S11 to S1*n* in response to the first scan start signal FLM1. The second scan driver 240 may sequentially supply the second scan signal to the second scan lines S21 to S2*n* in response to the second scan start signal FLM2. The third scan driver 260 may sequentially supply the third scan signal to the third scan lines S31 to S3*n* in response to the third scan start signal FLM3. The fourth scan driver 280 may sequentially supply the fourth scan signal to the fourth scan lines S41 to S4*n* in response to the fourth scan start signal FLM4.

Figure 3:
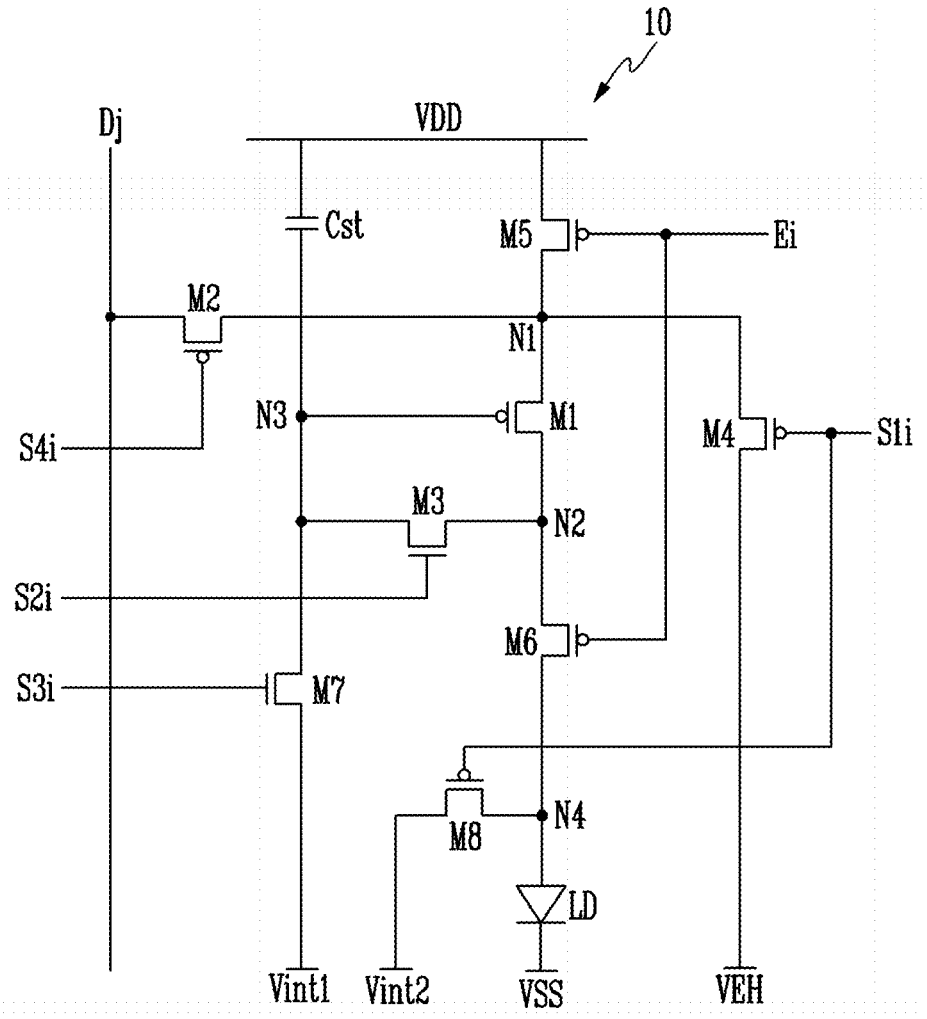
FIG. 3 is a circuit diagram illustrating an embodiment of a pixel included in the display device shown in FIG. 1.

FIG. 3 is a circuit diagram illustrating an embodiment of the pixel included in the display device shown in FIG. 1.

For convenience of description, a pixel 10 which is disposed on an ith horizontal line (or ith pixel row) and is coupled to a jth data line Dj will be illustrated in FIG. 3 (i and j are natural numbers).

Referring to FIGS. 1 and 3, the pixel 10 may include a light emitting device LD, first to eighth transistors M1 to M8, and a storage capacitor Cst.

A first electrode (e.g., anode electrode or cathode electrode) of the light emitting device LD may be coupled to the sixth transistor M6, and a second electrode (e.g., cathode electrode or anode electrode) of the light emitting device LD may be coupled to the second driving power source VSS. The light emitting device LD may generate light with a predetermined luminance corresponding to an amount of current supplied from the first transistor M1.

In an embodiment, the light emitting device LD may be an organic light emitting diode including an organic emitting layer. In another embodiment, the light emitting device LD may be an inorganic light emitting device including an inorganic material. In another embodiment, the light emitting device LD may be a light emitting device complexly configured with an inorganic material and an organic material. In an alternative embodiment, the light emitting device LD may have a form in which a plurality of inorganic light emitting devices is coupled in parallel and/or series between the second driving power source VSS and the sixth transistor M6.

A first electrode of the first transistor M1 (or driving transistor) may be coupled to a first node N1, and a second electrode of the first transistor M1 may be coupled to a second node N2. A gate electrode of the first transistor M1 may be coupled to a third node N3. The first transistor M1 may control an amount of current flowing from the first driving power source VDD to the second driving power source VSS via the light emitting device LD, corresponding to a voltage of the third node N3. To this end, the first driving power source VDD may be set to a voltage higher than that of the second driving power source VSS.

The second transistor M2 may be coupled between the jth data line Dj (hereinafter, also referred to as a data line) and the first node N1. A gate electrode of the second transistor M2 may be coupled to an ith fourth scan line S4*i* (hereinafter, also referred to as a fourth scan line). The second transistor M2 may be turned on when a fourth scan signal is supplied to the fourth scan line S4*i*, to allow the data line Dj and the first node N1 to be electrically coupled to each other.

The third transistor M3 may be coupled between the second electrode of the first transistor M1 (i.e., the second node N2) and the third node N3. A gate electrode of the third transistor M3 may be coupled to an ith second scan line S2*i* (hereinafter, also referred to as a second scan line). The third transistor M3 may be turned on when a second scan signal is supplied to the second scan line S2*i*, to allow the second electrode of the first transistor M1 and the third node N3 to be electrically coupled to each other. That is, a timing at which the second electrode (e.g., a drain electrode) of the first transistor M1 and the gate electrode of the first transistor M1 are coupled to each other may be controlled by the second scan signal. When the third transistor M3 is turned on, the first transistor M1 may be diode-coupled.

The fourth transistor M4 may be turned on in a first scan signal supplied to an ith first scan line S1*i* (hereinafter, also referred to as a first scan line), to supply a voltage of the first power source VEH to the first transistor M1. In an embodiment, the fourth transistor M4 may be coupled between the first node N1 and the first power source VEH. A timing at which the voltage of the first power source VEH is supplied to the first node N1 may be controlled by the first scan signal.

A gate electrode of the fourth transistor M4 may be coupled to the first scan line S1*i*. When the fourth transistor M4 is turned on, the voltage of the first power source VEH may be supplied to the first node N1. In an embodiment, the voltage of the first power source VEH may have a level similar to that of a data voltage of a black grayscale. In an embodiment, the voltage of the first power source VEH may have a level of about 5 volts (V) to about 7V, for example.

Accordingly, a predetermined high voltage may be applied to a source electrode of the first transistor M1 when the fourth transistor M4 is turned on. When the third transistor M3 is in a turn-off state, the first transistor M1 may have an on-bias state (i.e., a state in which the first transistor M1 may be turned on). That is, the first transistor M1 may be on-biased.

The fifth transistor M5 may be coupled between the first driving power source VDD and the first node N1. A gate electrode of the fifth transistor M5 may be coupled to an ith emission control line Ei (hereinafter, also referred to as an emission control line). The fifth transistor M5 is turned off when an emission control signal is supplied to the emission control line Ei, and is turned on in other cases.

The sixth transistor M6 may be coupled between the second electrode of the first transistor M1 (i.e., the second node N2) and the first electrode of the light emitting device LD (i.e., a fourth node N4). A gate electrode of the sixth transistor M6 may be coupled to the emission control line Ei. The sixth transistor M6 may be controlled substantially identical to the fifth transistor M5.

The seventh transistor M7 may be coupled between the third node N3 and a second power source Vint1 (hereinafter, also referred to as a first initialization power source). A gate electrode of the seventh transistor M7 may be coupled to an ith third scan line S3*i* (hereinafter, also referred to as a third scan line). The seventh transistor M7 may be turned on when a third scan signal is supplied to the third scan line S3*i*, to supply a voltage of the first initialization power source Vint1 to the third node N3. The voltage of the first initialization power source Vint1 is set to a voltage lower than that of a data signal supplied to the data line Dj.

Accordingly, a gate voltage of the first transistor M1 may be initialized to the voltage of the first initialization power source Vint1 when the seventh transistor M7 is turned on.

The eighth transistor M8 may be coupled between the first electrode of the light emitting device LD (i.e., the fourth node N4) and a third power source Vint2 (hereinafter, also referred to as a second initialization power source). In an embodiment, a gate electrode of the eighth transistor M8 may be coupled to the first scan line S1*i*. The eighth transistor M8 may be turned on when the first scan signal is supplied to the first scan line S1*i*, to supply a voltage of the second initialization power source Vint2 to the first electrode of the light emitting device LD.

When the voltage of the second initialization power source Vint2 is supplied to the first electrode of the light emitting device LD, a parasitic capacitor of the light emitting device LD may be discharged. Since a residual voltage charged in the parasitic capacitor is discharged (removed), unintended minute emission may be prevented. Thus, the black expression ability of the pixel 10 may be improved.

The first initialization power source Vint1 and the second initialization power source Vint2 may generate different voltages from each other. That is, a voltage for initializing the third node N3 and a voltage for initializing the fourth node N4 may be set different from each other.

In low-frequency driving in which the time length of one frame period is lengthened, when the voltage of the first initialization power source Vint1, which is supplied to the third node N3, is excessively low, a strong on-bias is applied to the first transistor M1, and therefore, a threshold voltage of the first transistor M1 in the corresponding frame period is shifted. Such a hysteresis characteristic may cause a flicker phenomenon in the low-frequency driving. Therefore, in the low-frequency driving, the voltage of the first initialization power source Vint1, which is higher than that of the second driving power source VSS, may be desired in the display device.

However, when the voltage of the second initialization power source Vint2, which is supplied to the fourth node N4, is higher than a predetermined reference voltage, the voltage of the parasitic capacitor of the light emitting device LD is not discharged, but the parasitic capacitor may be charged. Therefore, the voltage of the second initialization power source Vint2 is to be lower than that of the second driving power source VSS.

However, this is merely illustrative, and the voltage of the first initialization power source Vint1 and the voltage of the second initialization power source Vint2 may be substantially the same.

The storage capacitor Cst is coupled between the first driving power source VDD and the third node N3. The storage capacitor Cst may store a voltage applied to the third node N3.

The first transistor M1, the second transistor M2, the fourth transistor M4, the fifth transistor M5, the sixth transistor M6, and the eighth transistor M8 may be implemented with a poly-silicon semiconductor transistor. In an embodiment, the first transistor M1, the second transistor M2, the fourth transistor M4, the fifth transistor M5, the sixth transistor M6, and the eighth transistor M8 may include a poly-silicon semiconductor layer provided as an active channel through a low temperature poly-silicon ("LTPS") process, for example. Also, the first transistor M1, the second transistor M2, the fourth transistor M4, the fifth transistor M5, the sixth transistor M6, and the eighth transistor M8 may be implemented with a p-type transistor (e.g., a PMOS transistor). Accordingly, a gate-on voltage at which the first transistor M1, the second transistor M2, the fourth transistor M4, the fifth transistor M5, the sixth transistor M6, and the eighth transistor M8 are turned on may have a logic low level.

Since the poly-silicon semiconductor transistor has a fast response speed, the poly-silicon semiconductor transistor may be applied to a switching element which desires fast switching.

The third transistor M3 and the seventh transistor M7 may be implemented with an oxide semiconductor transistor. In an embodiment, the third transistor M3 and the seventh transistor M7 may be implemented with an n-type oxide semiconductor transistor (e.g., an NMOS transistor), and include an oxide semiconductor layer as an active layer, for example. Accordingly, a gate-on voltage at which the third transistor M3 and the seventh transistor M7 are turned on may have a logic high level.

The oxide semiconductor transistor may be provided through a low temperature process, and have a charge mobility lower than that of a poly-silicon semiconductor transistor. That is, the oxide semiconductor transistor has an excellent off-current characteristic. Thus, when the third transistor M3 and the seventh transistor M7 are implemented with the oxide semiconductor transistor, leakage current from the second node N2 according to the low-frequency driving may be minimized, and accordingly, display quality may be improved.

Figure 4:
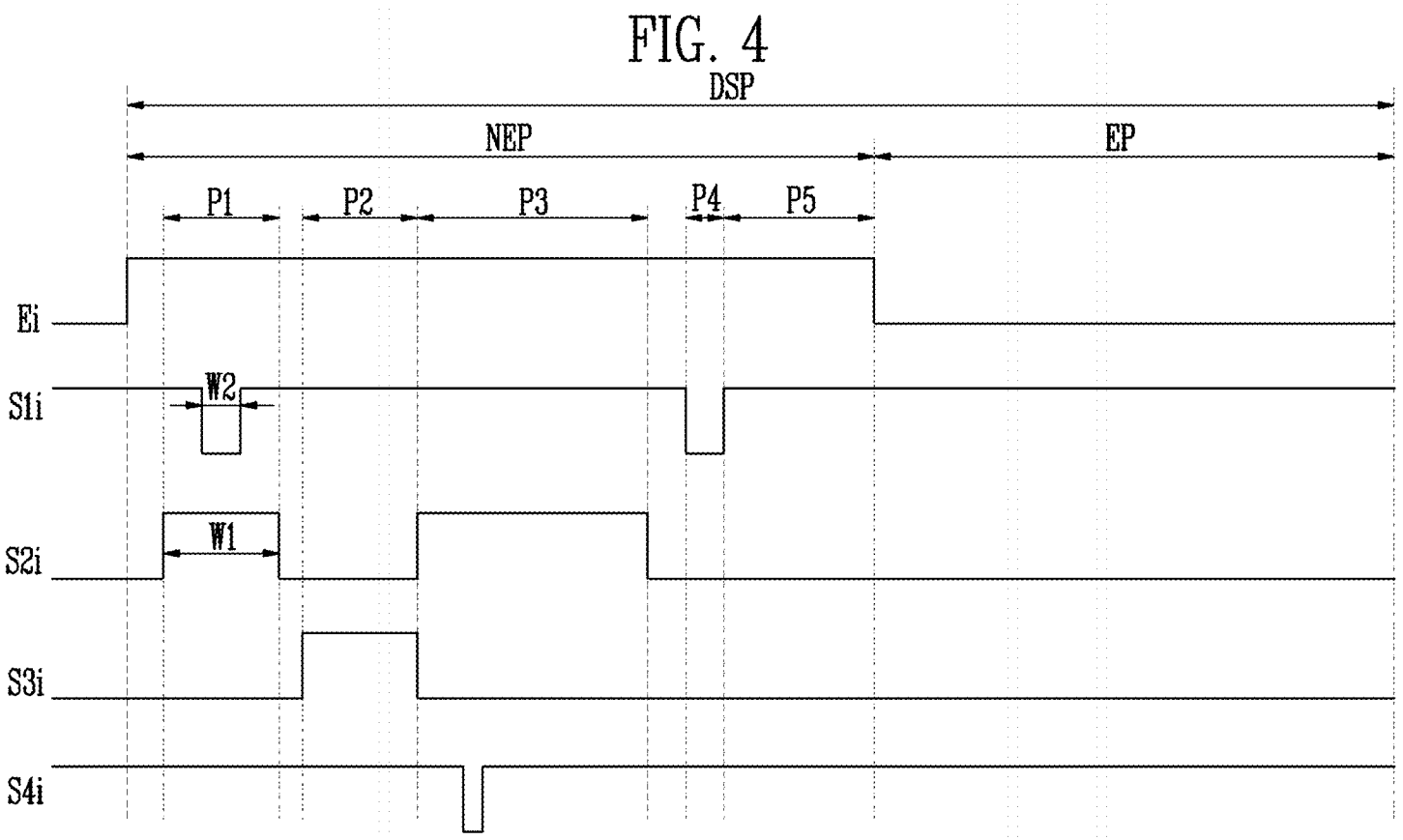
FIG. 4 is a timing diagram illustrating an embodiment of signals supplied to the pixel shown in FIG. 3.
Figure 5:
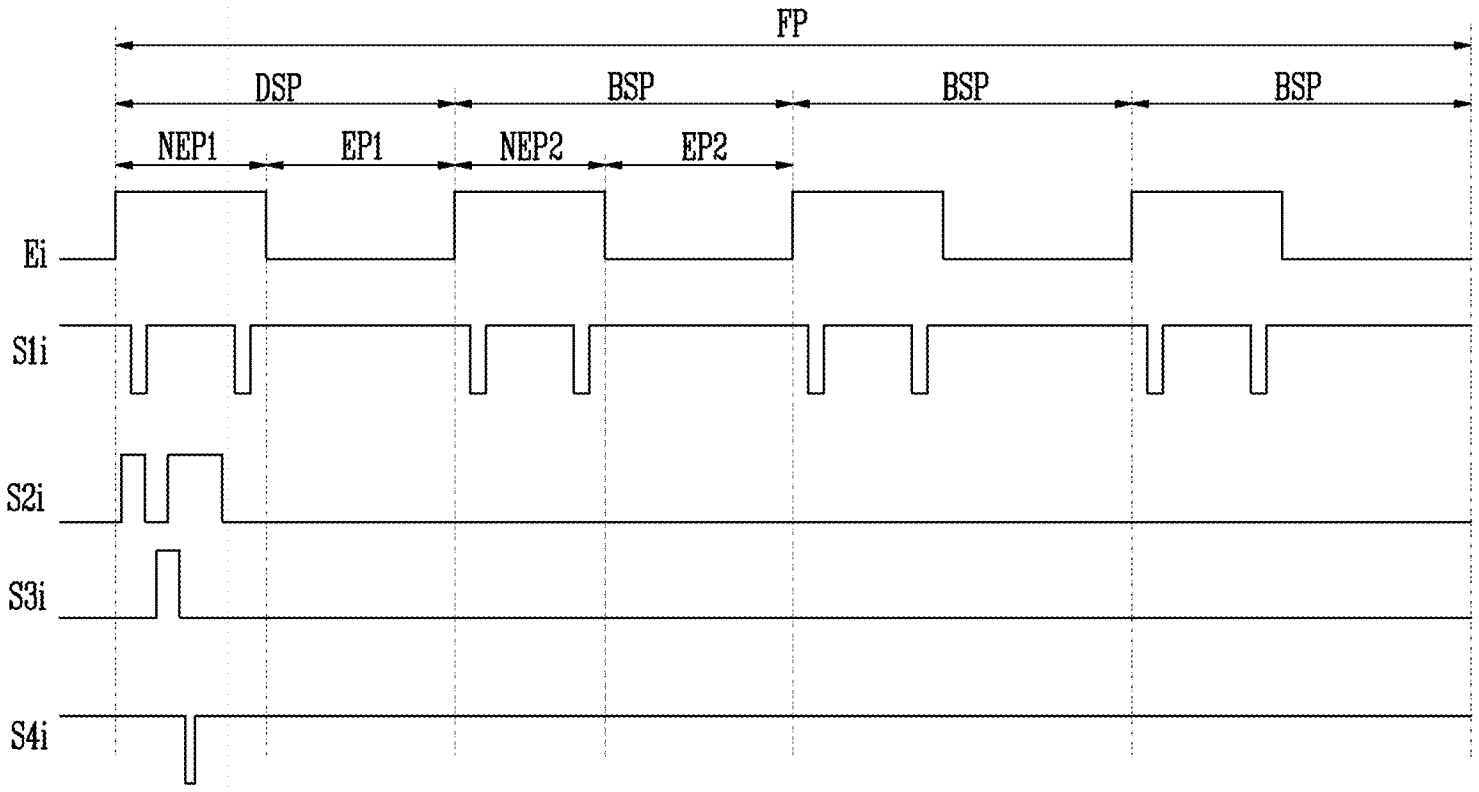
FIG. 5 is a timing diagram illustrating an embodiment of the signals supplied to the pixel shown in FIG. 3 during one frame period.

FIG. 4 is a timing diagram illustrating an embodiment of signals supplied to the pixel shown in FIG. 3. FIG. 5 is a timing diagram illustrating an embodiment of the signals supplied to the pixel shown in FIG. 3 during one frame period.

Referring to FIGS. 4 and 5, in variable frequency driving for controlling a frame frequency, one frame period FP may include a display scan period DSP and at least one bias scan period BSP.

The display scan period DSP may include a first non-emission period NEP1 and a first emission period EP1. The bias scan period BSP may include a second non-emission period NEP2 and a second emission period EP2. A non-emission period NEP and an emission period EP, which are shown in FIG. 4, may be respectively the first non-emission period NEP1 and the first emission period EP1, which are shown in FIG. 5.

The display scan period DSP includes a period in which a data signal actually corresponding to an output image is written. In an embodiment, when a still image is displayed through low-frequency driving, a data signal may be written for each display scan period DSP, for example.

As shown in FIG. 5, an emission control signal may be supplied to the emission control line Ei at a first frequency higher than the frame frequency. A third scan signal and a fourth scan signal may be supplied at a second frequency lower than the first frequency. In an embodiment, the first frequency may be about 240 Hz, and the second frequency may be about 60 Hz, for example. The frequency of the third scan signal and the fourth scan signal may be substantially equal to the frame frequency.

However, this is merely illustrative, and the second frequency may be about 60 Hz or lower. A number of times the bias scan period BSP is repeated in the frame period FP (i.e., a number of bias scan periods BSP) may increase as the second frequency becomes lower or as a difference between the first frequency and the second frequency becomes larger. In an embodiment, the frame period FP may include one display scan period DSP and a plurality of continuous bias scan periods BSP according to the frame frequency, for example.

In an embodiment, a second scan signal may be supplied only in the first non-emission period NEP1. The second scan signal may be supplied plural times to the second scan line S2*i* during the first non-emission period NEP1.

In an embodiment, a first scan signal may be supplied in the first non-emission period NEP1 and the second non-emission period NEP2. The first scan signal may be supplied plural times to the first scan line S1*i* in the first non-emission period NEP1. Also, the first scan signal may be supplied plural times to the first scan line S1*i* in the second non-emission period NEP2. The first scan signal may be a signal for controlling the first transistor M1 to be in the on-bias state. In an embodiment, when the fourth transistor M4 is turned on by the first scan signal, the voltage of the first power source VEH may be supplied to the first node N1, for example.

The display device in the embodiments of the invention may periodically apply the voltage of the first power source VEH to the source electrode of the first transistor M1 by the fourth transistor M4. When the voltage of the first power source VEH is supplied to the source electrode of the first transistor M1, the first transistor M1 may be in the on-bias state, and a threshold voltage characteristic of the first transistor M1 may be changed. Thus, the characteristic of the first transistor M1 is fixed to a predetermined state in the low-frequency driving, so that the first transistor M1 may be prevented from being degraded.

Although a case where the first scan signal is supplied in all the non-emission periods NEP1 and NEP2 has been illustrated in FIG. 5, the invention is not limited thereto. The first scan signal may be supplied in a portion of the second non-emission period NEP2. In an embodiment, the first scan signal may be supplied to the first scan line S1*i* only in the display scan period DSP and a second bias scan period BSP shown in FIG. 5, for example.

A period in which the emission control signal has a logic low level may correspond to the emission periods EP, EP1, and EP2, and a period except the emission periods EP, EP1, and EP2 may correspond to the non-emission periods NEP, NEP1, and NEP2.

A gate-on voltage of the second scan signal and the third scan signal, which are respectively supplied to the third transistor M3 and the seventh transistor M7, which are implemented with an n-type transistor, has a logic high level. A gate-on voltage of the fourth scan signal, which is supplied to the second transistor M2 which is implemented with a p-type transistor, and the first scan signal, which is supplied to each of the fourth transistor M4 and the eighth transistor M8 which are implemented with a p-type transistor, has a logic low level.

As shown in FIG. 5, the first scan signal may be supplied to the first scan line S1*i* in the second non-emission period NEP2 as a non-emission period of the bias scan period BSP. Therefore, the voltage of the first power source VEH may be supplied to the source electrode of the first transistor M1 in the second non-emission period NEP2. That is, an on-bias may be periodically applied to the first transistor M1, regardless of the frame frequency. In addition, the first scan signal may be supplied plural times to the first scan line S1*i* in the second non-emission period NEP2 so as to maintain a stable on-bias state. Accordingly, a change in luminance of the first transistor M1 during the frame period FP in the low-frequency driving may be minimized. The first scan signal may be supplied plural times to the first scan line S1*i* even in the display scan period DSP so as to drive the scan driver 200 and simplify the configuration of the display device 1000.

Hereinafter, scan signals supplied in the display scan period DSP and an operation of the pixel 10 will be described in detail with reference to FIG. 4.

The emission control signal may be supplied to the emission control line Ei during the non-emission period NEP. Accordingly, the fifth transistor M5 and the sixth transistor M6 may be turned off during the non-emission period NEP. The non-emission period NEP may include first to fifth periods P1 to P5.

In the first period P1, the scan driver 200 may supply the second scan signal to the second scan line S2*i*, and supply the first scan signal to the first scan line S1*i*. In an embodiment, the first scan signal may be supplied after the second scan signal is supplied. Therefore, in the first period P1, the fourth transistor M4 may be turned on after the third transistor M3 is turned on.

When only the fourth transistor M4 is turned on without supply of the second scan signal, the voltage of the first power source VEH may be supplied to the first node N1 (i.e., the source electrode of the first transistor M1). Since the voltage of the first power source VEH is about 5V or higher, the first transistor M1 may have the on-bias state. In an embodiment, the first transistor M1 may have a source voltage of about 5V or higher and a drain voltage of about 5V or higher, and the absolute value of a gate-source voltage of the first transistor M1 may increase, for example.

In this state, when a data signal is supplied by supply of the fourth scan signal, a driving current may be unintentionally changed due to influence of the bias state of the first transistor M1, and image luminance may be fluctuated (e.g., luminance increases)

In order to solve this problem, the scan driver 200 may supply the second scan signal earlier than the first scan signal in the first period P1. Therefore, the third transistor M3 may be turned on earlier than the fourth transistor M4. The second node N2 and the third node N3 may be coupled to each other when the third transistor M3 is turned on. Subsequently, when the fourth transistor M4 is turned on, the voltage of the first power source VEH may be transferred up to the third node N3 through the first node N1. In an embodiment, a voltage difference between the first node N1 and the third node N3 may be decreased to a threshold voltage level of the first transistor M1, for example. Therefore, the magnitude of the gate-source voltage of the first transistor M1 may be considerably lowered in the first period P1. In an embodiment, the first transistor M1 may be set to an off-bias state, for example.

As described above, in order to prevent an unintended increase in luminance, which is caused by the supply of the voltage of the first power source VEH before the data signal is written in the first period P1, the supply of the first scan signal and the second scan signal may be controlled such that the fourth transistor M4 is turned on in a state in which the third transistor M3 is turned on.

In an embodiment, a pulse width W1 of the second scan signal may be greater than that W2 of the first scan signal in the first period P1. In an embodiment, in the first period P1, the third transistor M3 may be turned on earlier than the fourth transistor M4, and be turned off after the fourth transistor M4 is turned off, for example.

However, this is merely illustrative, the third transistor M3 may be turned off earlier than the fourth transistor M4.

The eighth transistor M8 may be turned on in response to the first scan signal, and the voltage of the second initialization power source Vint2 may be supplied to the first electrode of the light emitting device LD (i.e., the fourth node N4).

Subsequently, in the second period P2, the scan driver 200 may supply the third scan signal to the third scan line S3*i*. The seventh transistor M7 may be turned on by the third scan signal. When the seventh transistor M7 is turned on, the voltage of the first initialization power source Vint1 may be supplied to the gate electrode of the first transistor M1. That is, in the second period P2, the gate voltage of the first transistor M1 may be initialized based on the voltage of the first initialization power source Vint1. Therefore, a strong on-bias may be applied to the first transistor M1, and the hysteresis characteristic may be changed (i.e., the threshold voltage is shifted).

Subsequently, in the third period P3, the scan driver 200 may supply the second scan signal to the second scan line S2*i*. The third transistor M3 may be again turned on in response to the second scan signal. In the third period P3, the scan driver 200 may supply the fourth scan signal to the fourth scan line S4*i* while overlapping with a portion of the second scan signal. The second transistor M2 may be turned on by the fourth scan signal, and the data signal may be supplied to the first node N1.

The first transistor M1 may be diode-coupled by the turned-on third transistor M3, and data signal writing and threshold voltage compensation may be performed. Since the supply of the second scan signal is maintained even after the supply of the fourth scan signal is suspended, the threshold voltage of the first transistor M1 may be compensated for a sufficient time length.

Subsequently, in the fourth period P4, the scan driver 200 may again supply the first scan signal to the first scan line S1*i*. Therefore, the fourth transistor M4 and the eighth transistor M8 may be turned on. The voltage of the first power source VEH may be supplied to the first node N1 when the fourth transistor M4 is turned on.

Influence of the strong on-bias applied in the second period P2 may be suppressed by a data signal writing and threshold voltage compensation operation. In an embodiment, a voltage difference between the gate voltage and the source voltage (and the drain voltage) of the first transistor M1 may be considerably decreased by the threshold voltage compensation in the third period P3, for example. Then, the characteristic of the first transistor M1 may be again changed, and the driving voltage in the emission period EP may increase or a change in black grayscale may be viewed.

In order to prevent such a characteristic change, the fourth transistor M4 may be turned on in the fourth period P4. Therefore, the voltage of the first power source VEH is supplied to the source electrode of the first transistor M1 in the fourth period P4, so that the first transistor M1 may be set to the on-bias state.

A sufficient spare time length is desired between the fourth period P4 and the emission period EP so as to set the first transistor M1 to be in a stable on-bias state by the operation in the fourth period P4. Therefore, the fifth period P5 in which the scan signals are not supplied may be inserted between the fourth period P4 and the emission period EP.

In an embodiment, the fifth period P5 may correspond to four horizontal periods. In an embodiment, a time length of the fifth period P5 may be equal to or greater than about 10 microseconds (μs). Accordingly, the first transistor M1 may have a stable on-bias state before the emission period EP. Thus, the emission luminance may be stably maintained even when the frame period FP shown in FIG. 5 is repeated.

In an embodiment, the first to fourth scan signals may be respectively supplied from the first to fourth scan drivers shown in FIG. 2.

Figure 6A:
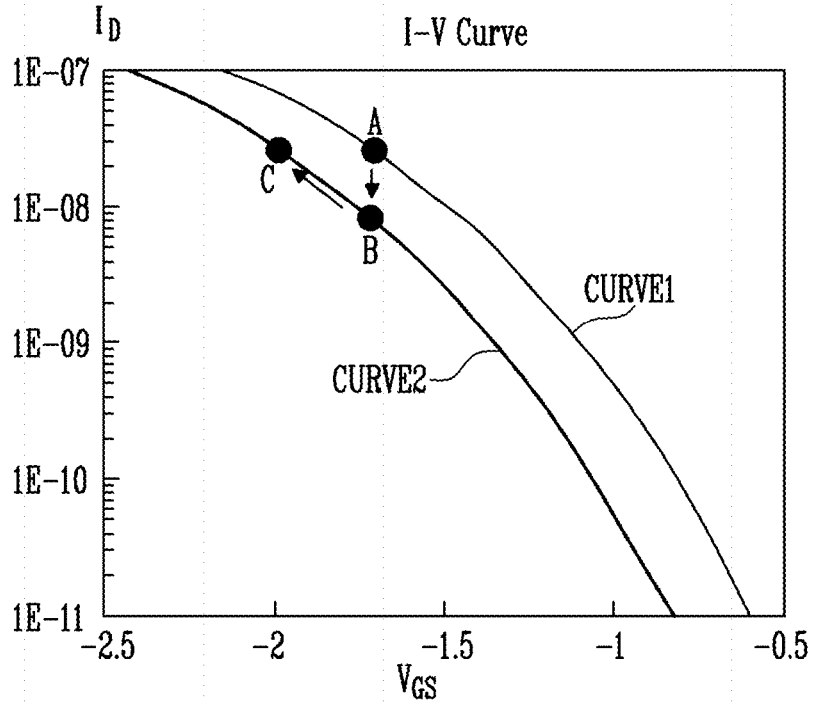
FIGS. 6A and 6B are diagrams illustrating an embodiment of a change in driving current of a first transistor of the pixel shown in FIG. 3 according to a bias state of the first transistor.
Figure 6B:
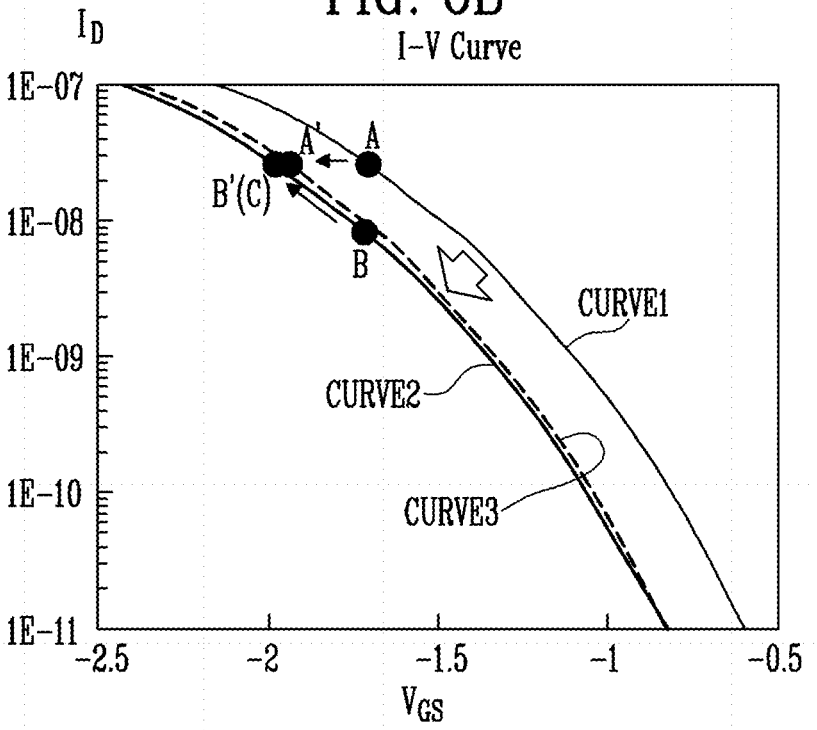

FIGS. 6A and 6B are diagrams illustrating an embodiment of a change in driving current of the first transistor of the pixel shown in FIG. 3 according to a bias state of the first transistor.

Referring to FIGS. 3, 4, 6A, and 6B, the feature of a change in driving current $I_D$ may be changed depending on whether the second period P2 is included in the display scan period DSP.

FIG. 6A illustrates change in driving current $I_D$ according to gate-source voltage VGS of the first transistor M1 in driving in which the second period P2 is not included in the display scan period DSP.

A first curve CURVE1 represents a relationship between the gate-source voltage VGS and the driving current $I_D$ (hereinafter, also referred to as an I-V curve) after the first transistor M1 is set to the off-bias state, and a second curve CURVE2 represents a relationship between the gate-source voltage VGS and the driving current $I_D$ after the first transistor M1 is set to the on-bias state. That is, the I-V curve and the threshold voltage of the first transistor M1 may be changed according to a change in bias state.

In FIG. 6A, a frame elapses in an order of A→B→C. In an embodiment, a driving current $I_D$ corresponding to point A may be generated in a first frame, a driving current $I_D$ corresponding to point B may be generated in a second frame, and a driving current $I_D$ corresponding to point C may be generated in a third frame, for example.

As shown in FIG. 6A, the driving current $I_D$ is rapidly changed according to the change in bias state, and therefore, a change in luminance may be viewed.

FIG. 6B illustrates an I-V curve in a configuration in which the second period P2 is included in the display scan period DSP. That is, the first curve CURVE1 may be shifted to a third curve CURVE2 by the operation of turning on the seventh transistor M7 in the second period P2. In an embodiment, the third curve CURVE3 may be similar to the second curve CURVE2 as an I-V curve in the on-bias state, for example. The I-V curve of the first transistor M1 may be changed in an order of the first curve CURVE1→the third curve CURVE3→the second curve CURVE2. Thus, the response speed of the first transistor M1 may be improved.

That is, the on-bias of the first transistor M1 is applied before the data signal is written, so that the driving current $I_D$ may be changed in an order of A'→B'→C. Since the I-V curve is shifted due to the initialization of the gate voltage of the first transistor M1 in the second period P2, the response speed of the first transistor M1 is improved, so that the driving current $I_D$ and luminance fluctuation may be minimized.

Figure 7:
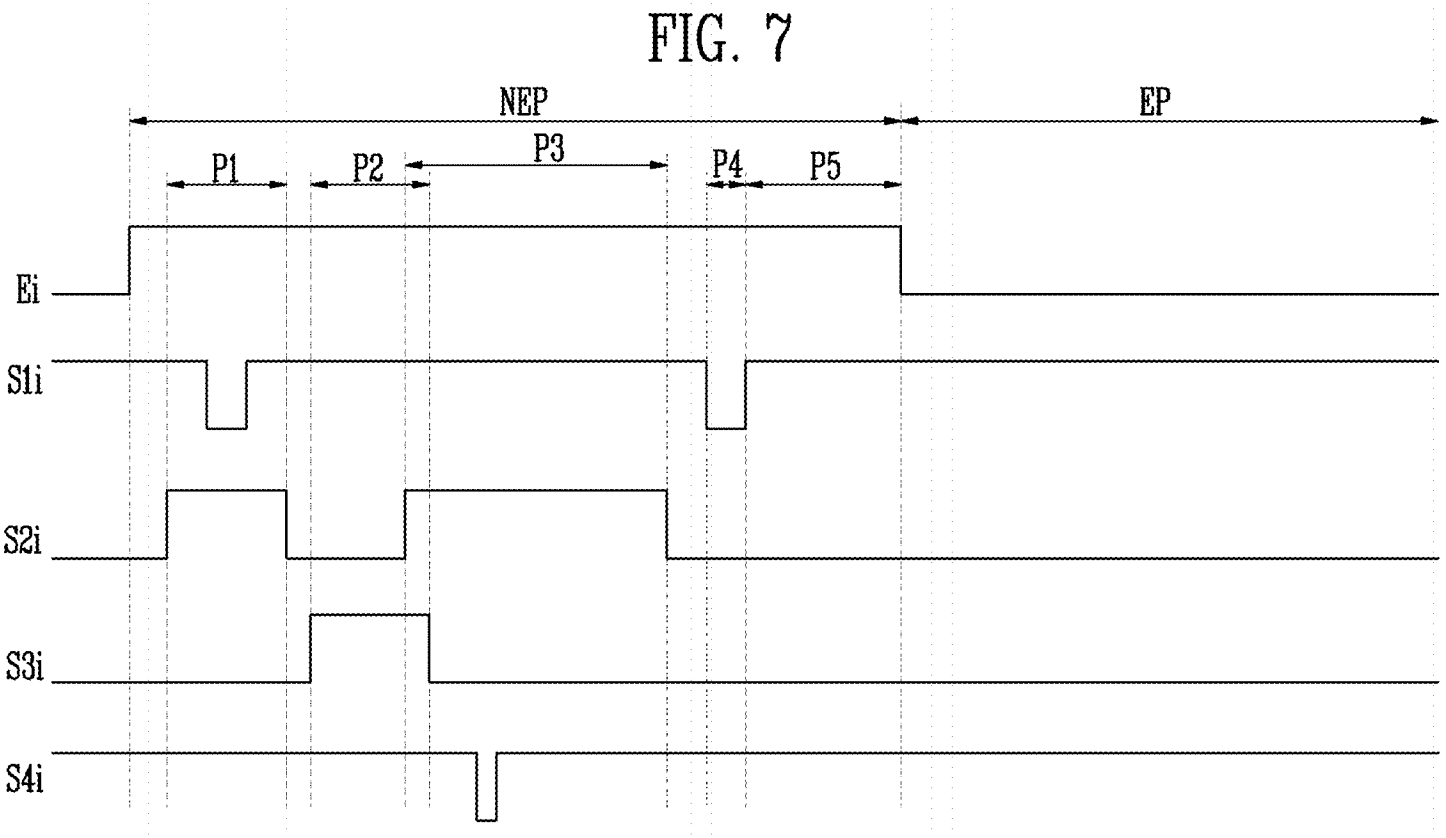
FIG. 7 is a timing diagram illustrating another embodiment of the signals supplied to the pixel shown in FIG. 3.
Figure 8:
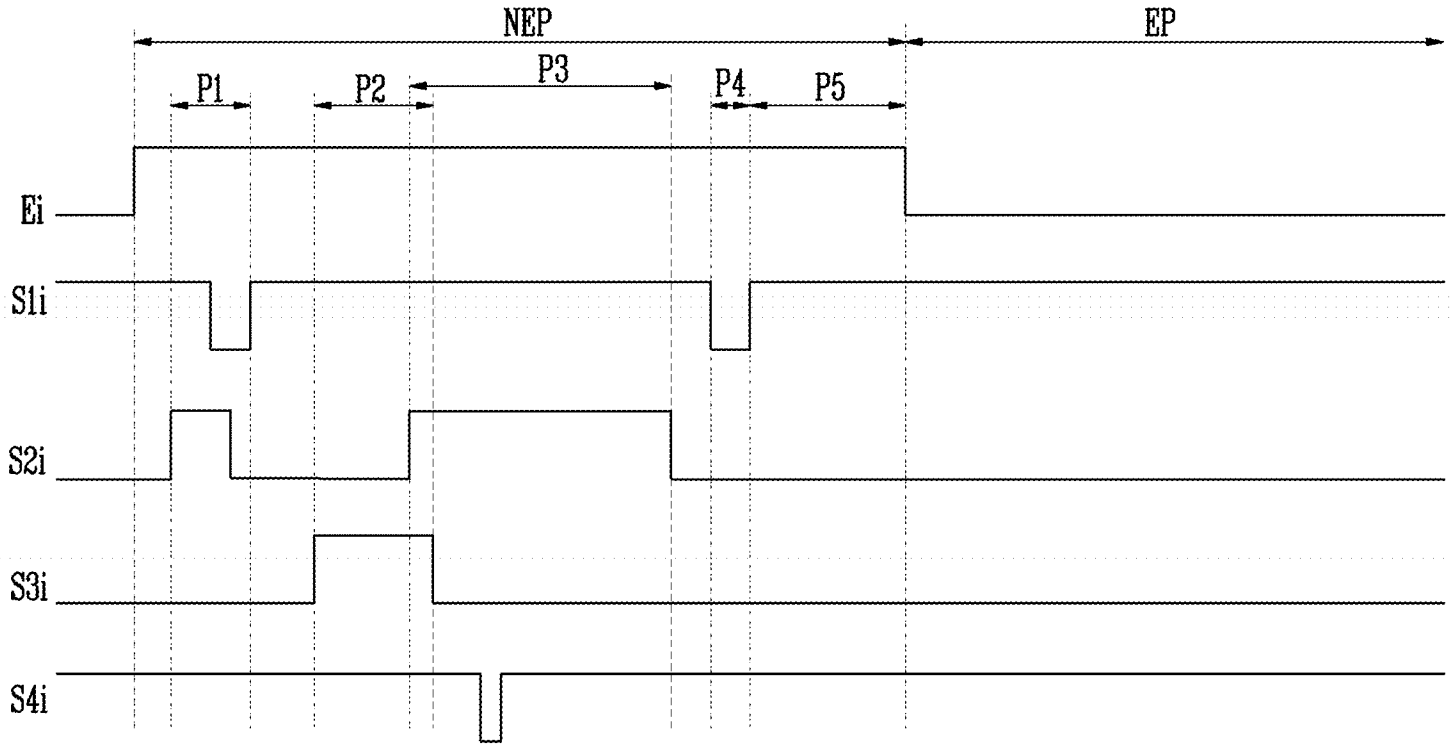
FIG. 8 is a timing diagram illustrating still another embodiment of the signals supplied to the pixel shown in FIG. 3.

FIG. 7 is a timing diagram illustrating another embodiment of the signals supplied to the pixel shown in FIG. 3. FIG. 8 is a timing diagram illustrating still another embodiment of the signals supplied to the pixel shown in FIG. 3.

The timing diagrams shown in FIGS. 7 and 8 are identical or similar to the timing diagram shown in FIG. 4, except widths and supply timings of some scan signals. Therefore, components identical or corresponding to those shown in FIG. 4 are designated by like reference numerals, and overlapping descriptions will be omitted.

Referring to FIGS. 7 and 8, the non-emission period NEP of the display scan period NEP may include first to fifth periods P1 to P5.

In an embodiment, as shown in FIG. 7, the second period P2 and the third period P3 may partially overlap with each other. That is, the third transistor M3 may be turned on in response to the second scan signal in a state in which the seventh transistor M7 is turned on. The voltage of the first initialization power source Vint1 is in a state in which the voltage of the first initialization power source Vint1 has already been supplied to the third node N3, and the first transistor M1 has been on-biased. Hence, a characteristic of the first transistor M1 according to signal supply shown in FIG. 7 may be similar to that of the first transistor M1 according to the driving in the second period P2 and the third period P3, which are shown in FIG. 4.

In an embodiment, as shown in FIG. 8, the supply of the first scan signal may be suspended after the supply of the second signal is suspended in the first period P1. In the first period P1, the fourth transistor M4 may be turned on after the third transistor M3 is turned on, and be turned off after the third transistor M3 is turned off. Since a voltage having a level similar to that of the voltage of the first power source VEH is supplied to the second node N2, a characteristic of the first transistor ml in the first period shown in FIG. 8 may be similar to that of the first transistor ml in the first period shown in FIG. 4.

As described above, some scan signals may be output with a predetermined margin according to a waveform of clock signals supplied to the scan driver 200, an output characteristic of a circuit included in the scan driver 200, etc.

Figure 9:
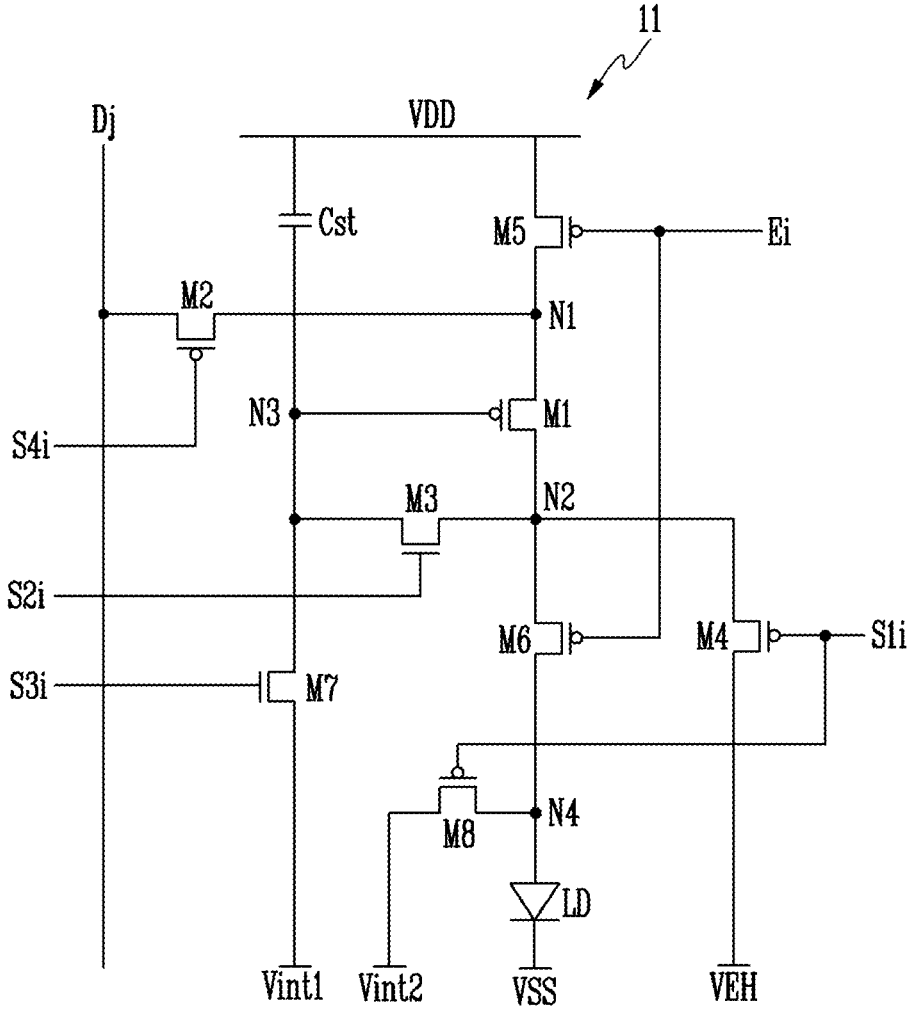
FIG. 9 is a circuit diagram illustrating another embodiment of the pixel included in the display device shown in FIG. 1.

FIG. 9 is a circuit diagram illustrating another embodiment of the pixel included in the display device shown in FIG. 1.

A pixel 11 shown in FIG. 9 has a configuration and an operation, which are identical to those of the pixel 10 described with reference to FIG. 3, except a fourth transistor M4. Therefore, components identical or corresponding to those shown in FIG. 3 are designated by like reference numerals, and overlapping descriptions will be omitted.

Referring to FIG. 9, the pixel 11 may include a light emitting device LD, first to eighth transistors M1 to M8, and a storage capacitor Cst.

In an embodiment, one electrode of the fourth transistor M4 may be coupled to the second node N2, and the other electrode of the fourth transistor M4 may be coupled to the first power source VEH. The fourth transistor M4 may supply the voltage of the first power source VEH to the second node N2 in response to the first scan signal supplied to the first scan line S1*i*. As described above, a voltage for on-bias may be supplied to any one of the source electrode and the drain electrode of the first transistor M1.

In an embodiment, the other electrode of the fourth electrode M4 may be coupled to the emission control line Ei instead of the first power source VEH. When the fourth transistor M4 is turned on, the logic high level of the emission control signal may be supplied to the second node N2.

As described above, in the display device in the embodiments of the invention, the fourth transistor M4 is turned on in a state in which the third transistor M3 is turned on before a data signal is written in the display scan period of variable frequency driving and low-frequency driving. Thus, luminance uniformity may be improved, and occurrence of a flicker may be minimized.

All the transistors of the pixel are turned off (i.e., the scan signals are not supplied) during a time length equal to or greater than 10 μs between the fourth period in which the voltage of the first power source is supplied to the pixel and a start of the emission period, so that the on-bias state of the first transistor M1 may be reset before light emission. Thus, an unintended increase in luminance, which is caused by initialization of the gate voltage of the first transistor M1 (i.e., in the second period) may be suppressed or prevented.

Accordingly, the image quality of the display device to which variable frame frequency driving including a plurality of emission periods and a plurality of non-emission periods in one frame period may be improved.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention.

What is claimed is:

1. A display device comprising:

a pixel including a first transistor coupled between a first node and a second node to generate a driving current, the pixel being connected to a first scan line, a second scan line, a third scan line, a fourth scan line, an emission control line, and a data line;

an emission driver which supplies an emission control signal at a first frequency to the emission control line;

a scan driver which supplies first to fourth scan signals respectively to the first to fourth scan lines in a period in which the emission control signal is supplied;

a data driver which supplies a data signal to the data line; and a timing controller which controls driving of the scan driver, the emission driver, and the data driver, wherein the first scan signal controls a timing at which a voltage of a first power source is supplied to the first node or the second node, the second scan signal controls a timing at which a first electrode of the first transistor and a gate electrode of the first transistor are coupled to each other, and the scan driver controls a bias state of the first transistor by supplying, plural times, the first scan signal and the second scan signal in a non-emission period in which the emission control signal is supplied.

2. The display device of claim 1, wherein the pixel further includes:

a light emitting device;

a second transistor coupled between the data line and the first node, the second transistor being turned on in response to the fourth scan signal supplied to the fourth scan line;

a third transistor coupled between the second node and a third node connected to the gate electrode of the first transistor, the third transistor being turned on in response to the second scan signal;

a fourth transistor turned on in response to the first scan signal supplied to the first scan line to apply the voltage of the first power source to the first transistor;

a fifth transistor coupled between a driving power source and the first node, the fifth transistor being turned off in response to the emission control signal supplied to the emission control line; and a sixth transistor coupled between the second node and a first electrode of the light emitting device, the sixth transistor being turned off in response to the emission control signal supplied to the emission control line.

3. The display device of claim 2, wherein, in a first period of the non-emission period, the scan driver supplies the second scan signal to the second scan line, and supplies the first scan signal to the first scan line.

4. The display device of claim 3, wherein, in the first period, the fourth transistor is turned on after the third transistor is turned on.

5. The display device of claim 4, wherein, in the first period, a time length during which the third transistor is turned on is longer than a time length during which the fourth transistor is turned on.

6. The display device of claim 3, wherein the pixel further includes:

a seventh transistor coupled between the third node and a second power source, the seventh transistor being turned on in response to the third scan signal supplied to the third scan line.

7. The display device of claim 6, wherein the scan driver:

supplies the third scan signal to the third scan line in a second period of the non-emission period; and supplies the second scan signal to the second scan line in a third period of the non-emission period.

8. The display device of claim 7, wherein the second period is started between the first period and the third period.

9. The display device of claim 7, wherein, in the third period, the scan driver supplies the fourth scan signal to the fourth scan line while overlapping with a portion of the second scan signal.

10. The display device of claim 7, wherein the scan driver again supplies the first scan signal to the first scan line in a fourth period after the third period.

11. The display device of claim 10, wherein the supply of the first to fourth scan signals is suspended during a remained period of the non-emission period after the fourth period, and wherein a time length of the remained period is greater than a pulse width of the first scan signal.

12. The display device of claim 11, wherein the time length of the remained period is equal to or greater than about 10 microseconds.

13. The display device of claim 12, wherein the scan driver supplies the third scan signal and the fourth scan signal at a second frequency corresponding to a frame frequency, and wherein the second frequency is lower than the first frequency.

14. The display device of claim 13, wherein a frame period includes a plurality of non-emission periods, wherein the scan driver supplies the first scan signal in the plurality of non-emission periods, and wherein the scan driver supplies the second scan signal, the third scan signal, and the fourth scan signal only in a first non-emission period among the plurality of non-emission periods.

15. The display device of claim 6, wherein the pixel further includes:

an eighth transistor coupled between the first electrode of the light emitting device and a third power source, the eighth transistor being turned on in response to the first scan signal.

16. The display device of claim 3, wherein one electrode of the fourth transistor is coupled to the first node.

17. The display device of claim 3, wherein one electrode of the fourth transistor is coupled to the second node.

18. The display device of claim 3, wherein the scan driver comprises:

a first scan driver which supplies a plurality of first scan signals to the first scan line during the non-emission period;

a second scan driver which supplies a plurality of second scan signals to the second scan line during the non-emission period;

a third scan driver which supplies the third scan signal to the third scan line between times at which the plurality of second scan signals is supplied; and a fourth scan driver which supplies the fourth scan signal to the fourth scan line while overlapping with portions of the plurality of second scan signals.

* * * * *